United States Patent [19]

Hofmann et al.

[11] Patent Number: 4,506,187

[45] Date of Patent: Mar. 19, 1985

[54] LAMP FILAMENT STRUCTURE, AND METHOD OF ITS MANUFACTURE

[75] Inventors: Dieter Hofmann, Augsburg; Erolf Weinhardt, Diedorf, both of Fed. Rep. of Germany

[73] Assignee: Patent-Treuhand-Gesellschaft fur elektrische Gluhlampen mbH, Munich, Fed. Rep. of Germany

[21] Appl. No.: 385,013

[22] Filed: Jun. 4, 1982

[30] Foreign Application Priority Data

Jun. 12, 1981 [DE] Fed. Rep. of Germany ..... 3123442

[51] Int. Cl.[3] ..... H01J 1/02; H01J 9/02

[52] U.S. Cl. ..... 313/341; 313/343; 313/344; 313/345; 445/50

[58] Field of Search ..... 313/341, 343, 344, 345; 445/48, 50

[56] References Cited

U.S. PATENT DOCUMENTS

| | | | |
|---|---|---|---|
| 1,668,016 | 5/1928 | Hauschild et al. | 445/48 X |
| 2,479,193 | 8/1949 | Zabel | 313/344 X |
| 2,922,916 | 1/1960 | Sharkey | 313/344 |
| 3,294,125 | 12/1966 | Heine | 313/344 X |
| 3,736,458 | 5/1973 | Miller, Jr. et al. | 313/344 |
| 3,908,251 | 9/1975 | Roy et al. | 313/344 X |

*Primary Examiner*—David K. Moore
*Assistant Examiner*—Vincent DeLuca
*Attorney, Agent, or Firm*—Frishauf, Holtz, Goodman & Woodward

[57] ABSTRACT

The amount of emitter paste which can be applied to the filament used in fluorescent tubes can be increased by winding the filament, as previously proposed, about an iron or molybdenum mandrel which can be dissolved; in contrast to the prior art, however, the wound filament is not annealed at a temperature which removes winding stresses but, rather, at a lower temperature of about for example 900° C. for tungsten wire, thus retaining some of the winding stresses. Upon dissolving-out of the iron core or mandrel, the remaining stresses will cause adjacent windings of the filament to slightly relieve their stresses by springing back to some extent, resulting in relatively offset end portions of the wires with respect to each other, when the wires have been wound on a mandrel which has an essentially rectangular cross section in which the ratio of length to width—in cross section—is greater than 2. The resulting surface roughness of an envelope of the filament permits retention of a larger amount of emitter material with better retention capabilities, and thus increases the lifetime of lamps by about 30% with respect to lamps having filaments in which adjacent windings are congruent.

20 Claims, 6 Drawing Figures

LAMP FILAMENT STRUCTURE, AND METHOD OF ITS MANUFACTURE

The present invention relates to a filament for an electric lamp, and more particularly to filaments for fluorescent lamps, which are to be coated with an emission coating, and to a method of its manufacture.

Background. Filaments, and particularly filaments which are to be heated to incandescence, especially filaments for fluorescent lamps which are to be covered with a coating, frequently are made this way: A mandrel is formed, which may be a flat piece of iron having a cross-sectional dimension in which the length L is greater than the width B (see FIGS. 2 and 4). Other materials than iron, for example molybdenum, may be used. The filament is then wound by winding the filament wire about the mandrel. Depending on the eventual structure of the filament desired, a serving wire of iron or molybdenum may be wound together with the actual filament wire about the mandrel, with an additional wrapping wire being wound about the combination of the filament-and-serving wire prior to winding the then resulting combination over the mandrel. A flat stick coil filament will then result.

Low-pressure discharge lamps, particularly fluorescent lamps, have filaments on which a paste of emitter material is applied. It is desirable to use as much paste as possible for any given length of wrapped filament. It is further desirable that the filament should heat as rapidly as possible in order to provide rapid emission. Low-pressure discharge lamps, thus, may use a filament which, in end view, is other than circular, that is, by being wrapped about a mandrel having the aforementioned different dimensions, in cross section, that is, length L and width B will be different (see FIG. 3). In many types of filaments, the wrapping wire is used which surrounds the actual filament and the additional serving wire made of molybdenum or iron. Then the filament—and, if used, the combination of filament, serving wire and wrapping wire—is annealed at between 1100° C. to about 1400° C. to release all tensions therein. In a further manufacturing step, the mandrel and—if used, the serving wire—are dissolved chemically.

In a further processing step, the then wrapped filament is cut and assembled in a lamp mount, to be then coated with emitter material.

The quantity of emitter material which can be taken up by such a wrapped filament substantially influences the length of the life of the lamp. When lamps are turned ON, some emitter material is sprayed off the emitter coating, that is, will be vaporized and deposited along the side of the lamp. This results in the well-known blackening at the end portions of fluorescent light tubes. The reduction in emitter material during burning of the lamp reduces the lifetime of the lamp.

The Invention. It is an object to provide a filament which can be easily coated with emitter material, permits an increased volume of emitter material in the zone of the filament without decreasing the heating power of the filament, so that the firing time of fluorescent tubes in which the filament is used is not increased, and in which spraying-off of the emitter material is reduced, so that the overall lifetime of the lamp is increased.

Briefly, the annealing step is carried out at a lower temperature than heretofore, so that, after the filament has been spirally wound on the mandrel, and the mandrel dissolved, all tension in the wire is not released, permitting the wire to "spring back" and thus provide for sequential turns which are offset with respect to each other. Since the filament wire will have been wound on a mandrel having, in cross section, a length-to-width relationship of preferably in the order of at least 2:1, filament windings will result which are partly formed of essentially straight portions and essentially circular portions, connecting the straight portions together. By not annealing the wire to release all tension but, rather, by annealing at a lower temperature, for example at a temperature up to about 900° C., which is substantially less than the prior annealing temperature, some springiness in the wire will remain so that, upon dissolution of the mandrel in a chemical bath, the round portions of the filament winding loops, connecting straight portions, will slightly uncurl or unwind to expand or stretch, or slightly straighten, resulting in a filament in which windings of adjacent rounded portions are offset with respect to a neighboring winding; typical offset angles are in the order of about 60° to 90°, although angles as small as 10° up to about 110° are suitable; the range is not critical. The envelope of the coiled filament will exhibit depressions and bulges or elevations and will be undulating due to the non-congruence of adjacent windings. In accordance with a feature of the invention, the envelope of the coiled filament should have at least five depressions for each centimeter of coiled filament length along the axis of the coiled filament.

The method, as well as the structure, may be used with single coiled filaments as well as with flat stick coiled filaments, that is, with filaments having a filament wire and a wrapping wire thereabout, which will remain after a serving wire of iron or molybednum, for example, has been removed together with the mandrel.

In accordance with a preferred form, every other winding of the filament forms a constriction or depression in the envelope of the filament. Preferably, each one of the part-circular portions of the filament, essentially, covers about the same sector of part of a circle, and has essentially the same radius of curvature. At least every other one of the part-circular portions, however, should be essentially similar.

The filaments can be used for fluorescent lamp filaments, but the invention is not restricted thereto; the filaments may be used for other types of lamps, in coiled-coil filaments for all types of low-pressure discharge lamps; the same process of manufacture may be used for any one of these applications.

The filament has the advantage that the outer surface is wavy or rough and thus, when having emitter material applied thereto, provides for better adhesion to the emitter. A substantially higher lifetime of lamps constructed with these types of filaments will result. The filaments can be made on existing filament winding machines with identical processing steps. The filaments, when finished, can be assembled on lamps or lamp mounts on existing machinery, without modification, so that no additional capital investment in lamp manufacture will result, while providing lamps of longer lifetime.

Applying the emitter, by pasting the emitter on the lamp mount, is easier when the lamp mounts have the filaments of the present invention applied. This is particularly so if the ratio of length L to width B in cross section of the mandrel is more than 2. In filaments of this type, and with equal capacity of emitter material of the finished filament, a smaller cross-sectional area than customary prior art flat filaments may result, thus decreasing the dissolving time of the mandrel. This reduces the manufacturing costs, both from a time as well as from a material consumption point of view. The filaments will be annealed at a lower temperature, so that energy for heating of the filament is also reduced.

DRAWINGS

Figure 1:
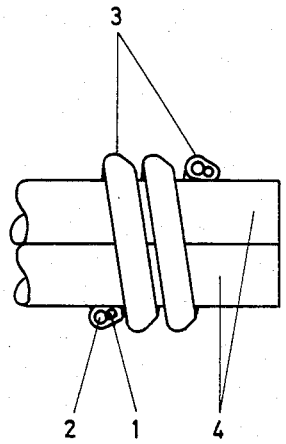
FIG. 1 illustrates, in general, the winding principle of a filament.
Figure 2:
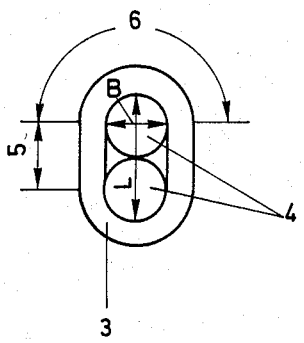
FIG. 2 is a schematic end view of FIG. 1.

A tungsten wire 1 forms the actual filament, the principle of winding of which will be described in connection with FIGS. 1 and 2. A serving wire 2, made of iron, is positioned parallel to the tungsten wire 1. The serving wire 2 and the tungsten wire 1 are surrounded by a coiled wrapping wire 3. The combination of the wires 1, 2, which may be termed linear wires, and the wrapping wire 3 is then wound on two parallel wires 4 which form a mandrel. The wires 4 are made of iron.

The diameters of the wires, in one illustrative example, are as follows:

tungsten wire 1: about 0.055 mm
serving wire 2, of iron: about 0.12 mm
wrapping wire 3, also of tungsten: about 0.022 mm
core or mandrel wires 4, of iron: 0.4 mm.

The relationship of the length L to the width B of the core structure formed by the two wires 4 is 2. In end view (see FIG. 2), the coil will have laterally positioned straight portions 5 and part-circular portions 6. The straight portions 5 are parallel to each other, and the essentially semi-circular elements 6 connect the straight portions 5 and form, essentially, a semi-circle around the wires 4. The windings are congruent with respect to each other along the axial length of the mandrel or core wires 4.

Figure 3:
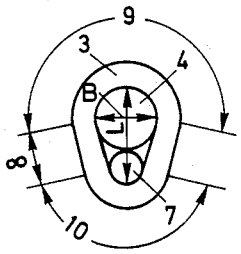
FIG. 3 illustrates an alternative construction to FIG. 2.

It is not necessary that the core wires 4 have the same diameter. FIG. 3 illustrates a further embodiment in which two core or mandrel wires 4 and 7 are used, in which core wire 7 has a smaller diameter than core wire 4. The relationship of the length L to the width B of the overall mandrel is less than 2. The end view shows essentially straight portions 8 and essentially part-circular portions 9, 10. Due to the different diameters of the mandrel or core wires 4, 7, the part-circular portion 9 covers more than a semi-circle; the respective windings about the mandrel or core wires 4, 7 are congruent in the prior art.

Figure 4:
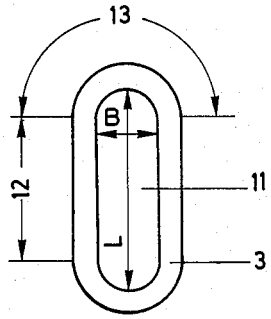
FIG. 4 illustrates a preferred embodiment, similar to FIG. 2.

In accordance with a preferred form of the invention, a flat core 11 is formed, as seen in FIG. 4, made of a flat iron wire, for example by flat-rolling iron wire having, in cross section, a length L of 0.8 mm and a width B of 0.25 mm. The ratio of length L to width B of the cross section of the flat core or mandrel 11 thus is 3.2, that is, greater than 2. Initially, the end view of the filament will have two straight portions 12 and two essentially semi-circular portions 13. The shape of the mandrel 11 can be matched to the shape of the filament which is required, in accordance with the eventual use to which the filament will be put, and the lamp in which it is to be used. It is possible to reduce the effective cross-sectional material of the mandrel by working-in longitudinally extending grooves in the longitudinal sides defining the length L, for example alongside straight portions 12, and thereby increase the effective surface on which a subsequent solvement may act, thereby decreasing the time of dissolving-out the core.

Up to this point, the filament made in accordance with the present invention can be manufactured similarly to prior art filaments. The final form, however, will differ and the construction of the filament will be illustrated in FIGS. 5 and 6, which will be obtained by annealing at a substantially lower temperature than heretofore customary, for example in the order of about 900° C.

Figure 5:
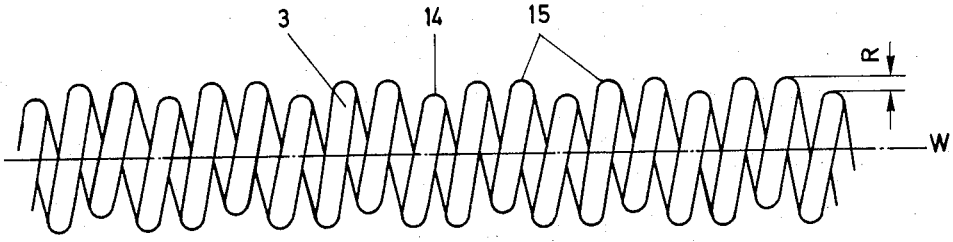
FIG. 5 is a schematic side view of a finished filament.

After winding the filament and forming a spinal coil, the filament is annealed at the lower temperature, leaving remaining tension within the filament in the thicker tungsten wire 1. Upon dissolving the mandrels 4, 7, 11 and the serving wire 2 in an acid bath, a composite filament formed of wires 1 and 3 will be left. The part-circular portions 6 (FIG. 2), 9, 10 (FIG. 3), 13 (FIG. 4) of the winding loops will spring back resiliently. FIG. 5 only illustrates the envelope of the wrapping wire 3 for clarity. As can be seen, the envelope of the overall filament will have depressions with respect to an average filament envelope, shown at 14, and bulges or elevations, shown at 15, i.e. have an undulating outline. In 1 cm coil length of filament, nine or depressions 14 will occur.

Figure 6:
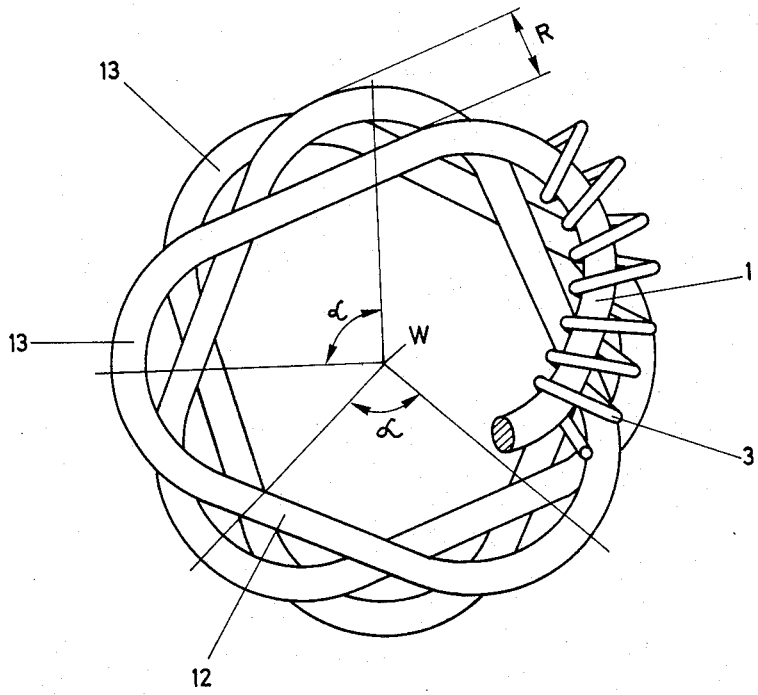
FIG. 6 is an end view of a portion of the filament, with a wrapping wire.

FIG. 6 illustrates an end view of a portion of the filament in which only a few windings are shown for clarity. FIG. 6 shows the filament wire 1 as well as the coiled wrap wire 3 after dissolving the serving wire 2 and the respective mandrel. Only a few of the windings of the wrap wire 3 coiled about wire 1 are shown for clarity of illustration.

The mandrel used for the filament of FIG. 6 is that of FIG. 4. After annealing at the lower temperature, and dissolving-out of the mandrel 11 and of the serving wire 2, the part-circular portions 13 will extend for less than a semi-circle; they are offset with respect to part-circular portions of adjacent windings by an angle $\alpha$ of about 90°. The value of the angle $\alpha$ is determined by the level of the annealing temperature; it can be readily reproduced in mass production technology. The difference in envelope aspect between a constriction or depression 14 and a projection 15 is a measure for the roughness R (FIGS. 5, 6) of the filament. It is particularly desirable to so control the annealing temperature, and hence the angle $\alpha$ and the resilient springiness of adjacent windings upon removal of the mandrel that a depression 14 and a projection 15 will be essentially aligned with respect to adjacent windings. The roughness R of the filament increases as the length L to width B of the core 11 increases beyond 2—see FIG. 4, and if the annealing temperature of the wound filament, before dissolving out of the mandrel, is in the order of about 900° C., in any event less than 1100° C. Basically, the temperature of annealing should be below that in which the resilient springiness of the wire disappears.

Upon further manufacture of the filament, that is, for example applying a paste of emitter material thereto, it has been found that the filament can accept about 10% more emitter material than prior art filaments of oval cross section which have been completely annealed. The emitter sputtering rate, for example in 40 W fluorescent lamps, is 20% less than prior art filaments of otherwise identical construction. With respect to lifetime, lamps with the filament retaining some springiness have a lifetime which is increased by about 30%.

The angles $\alpha$ are not critical; if the angle $\alpha$ is too small, the coiled shape of the filament will approach congruence of adjacent windings, which, as noted, is undesirable; as the angle increases up to about 120°, the end view would show approximately the shape of a triangle, with rounded corners. Offset of the respective part-circular portion of the windings with respect to adjacent windings would not be sufficient in order to retain the increased amount of emitter material. Thus, an offset in the order of about 60°–90° is preferred, which can be obtained in tungsten wire at an annealing temperature of about 900° C.

The end view of the filament is determined by the shape of the mandrel or core. Usually, and particularly for fluorescent lamps, the filament is wound about a flat strip of iron, or about two parallel iron wires, see FIGS. 2, 4. Frequently, the relationship of length L to width B, in cross section, is 2. In a preferred form, however, a single strip of iron is used, see FIG. 4, in which the relationship of length to width is greater than 2, and preferably in the order of about 3 or even more; to increase the speed of dissolving-out of the iron core, grooves may be formed in the sides, thereby increasing the surface of attack of the dissolving acid, similar to the dips between two adjacent wires as shown in FIG. 2. Annealing at the lower temperature of 900° C. retains some of the mechanical tension in the wire which is due to winding of the wire about the mandrel or core. Upon subsequent dissolution of the mandrel or core in an acid bath, the bent portion of the filament will spring back from the bent form by a predetermined amount, which is readily reproducible and controllable by controlling the annealing temperature. In the filament, essentially each one of the part-circular portions will have the same arc length, or angular arc coverage, and essentially the same radius of curvature. It is, of course, also possible to practice the invention with a mandrel or core as shown in FIG. 3, or having a cross section essentially similar thereto.

The relationships of the length L to the maximum width B, in cross section, of the mandrel may be less than 2, as seen, for example, in the embodiment of FIG. 3. In such a mandrel, every other one of two part-circular portions will, essentially, encompass the same arc or have the same arc length; and every other part-circular portion will have the same radius of curvature. In accordance with a preferred feature, however, the ratio of length L to the width B is greater than 2, since the depressions or restrictions of the envelope of the coil will be enhanced, which further increases retention of emitter material.

The filament may be a single filament, that is, retaining only the tungsten wire 1, or, as desired, may be a flat stick coil filament, including the wire 1 and the coiled wrapping wire 3.

FIG. 5 illustrates the filament in straight position along an axis W, for example before cutting to suitable length for incorporation in a lampmount. The emitter paste which can be used, for example when the filament is to be used with fluorescent lamps, can be in accordance with the standard composition, so that no change in its preparation or application with respect to prior art processes is necessary.

We claim:

1. Fluorescent lamp filament comprising a filament wire (1) and a wrapping wire (3) coiled about the filament wire to form a composite filament, said composite filament being in form of a spiral coil having a plurality of winding loops extending about an axis (W) in which each winding loop of the coil comprises a plurality of essentially straight portions (5, 8, 12);

a plurality of essentially part-circular portions (6, 9, 10, 13) adjoining the straight portions and connecting adjacent straight portions, and wherein the part-circular portion (6, 9, 10, 13) of any one winding loop is angularly offset about said axis (W) with respect to a corresponding part-circular portion of a neighboring winding loop by an angle ($\alpha$) of between 10° to 110°, whereby the envelope of the spiral coil will exhibit an undulating outline of depressions (14) and bulges or elevations (15) due to non-congruence of adjacent winding loops;

wherein the envelope of the coil has at least five depressions for each centimeter of coil length along said axis; and an emitter material applied and retained on said composite filament.

2. Filament according to claim 1, wherein said angle ($\alpha$) is between 60° to 90°.

3. Filament according to claim 1, wherein every second winding loop of the filament exhibits, with respect to an average outline of the envelope, a depression (14).

4. Filament according to claim 1, wherein at least every second part-circular portion (9, 10) covers approximately the same angular arc, and has a similar radius of curvature.

5. Filament according to claim 1, wherein each part-circular portion (6, 13) covers essentially the same circular arc and has the same radius of curvature.

6. Filament according to claim 1, wherein the filament comprises tungsten wire.

7. Filament according to claim 6, wherein the wrapping wire (3) wrapped about said tungsten wire (1) comprises tungsten wire.

8. Filament according to claim 1, wherein the ratio of the diameter of the essentially part-circular portion to the essentially straight portion is greater than 2.

9. Filament according to claim 8, wherein the ratio of the diameter of the essentially part-circular portion to the essentially straight portion is about 3.2.

10. Method of making a coiled fluorescent lamp filament comprising the steps of (a) providing an elongated winding mandrel of soluble material having, in cross section, a length L which is longer than its width B;

(b) spirally winding a composite filament having a linear filament wire (1) and a wrap wire (3) coiled about the linear filament wire on the mandrel about the axis (W) of the mandrel to form winding loops thereon and thereby causing resilient stresses to occur in the wire;

(c) subjecting the composite filament to a single heating step comprising heating the composite filament while wound on the mandrel to a temperature which is below the temperature in which resilient stresses due to winding are relieved to retain at least a remanent resilient winding stress in the wire;

(d) removing the mandrel after said heating step and permitting the remaining stress in the composite filament to be resliently relieved and the winding loops to resiliently partly uncurl or unwind about the winding radius, to position neighboring windings angularly offset about the winding axis (W) by an angle ($\alpha$) of between 10° to 110°; and (e) applying emitter material to the neighboring windings of the composite filament.

11. Method according to claim 10, wherein said step of providing the mandrel comprises providing a mandrel having a ratio of length L to width B which is greater than 2.

12. Method according to claim 10, including the step of providing a serving wire of soluble material, and wrapping a wrap wire (3) about the filament wire (1) and the serving wire (2) to form a composite wire;

and wherein said winding step comprises winding said composite wire about said mandrel.

13. Method according to claim 10, wherein said mandrel is made of iron or molybdenum.

14. Method according to claim 12, wherein the serving wire comprises the same material as said mandrel.

15. Method according to claim 10, wherein said step of removing the mandrel comprises chemically dissolving said mandrel.

16. Method according to claim 10, wherein said angle ($\alpha$) is between 60° to 90°.

17. Method according to claim 8, wherein the filament wire (1) and the wrap wire (3) are tungsten wires, and the filament is heated in said single heating step (c) to a temperature of below 1100° C.

18. Method according to claim 8, wherein the filament wire (1) and the wrap wire (3) are tungsten wires and the filament is heated in said single heating step (c) to a temperture of about 900° C.

19. Method according to claim 10, wherein the ratio of length L to width B of the mandrel is greater than 2.

20. Method according to claim 17, wherein the ratio of length L to width B of the mandrel is about 3.2.

* * * * *

UNITED STATES PATENT AND TRADEMARK OFFICE

CERTIFICATE OF CORRECTION

PATENT NO. : 4,506,187

DATED : March 19, 1985

INVENTOR(S) : Dieter HOFMANN et al

It is certified that error appears in the above-identified patent and that said Letters Patent is hereby corrected as shown below:

Column 8, line 20, that is Claim 20, line 1, change "claim 17" to -- claim 19 --

Column 4, line 17, change "spinal" to -- spiral --

Signed and Sealed this

*Third* Day of *September 1985*

[SEAL]

*Attest:*

DONALD J. QUIGG

*Attesting Officer* *Acting Commissioner of Patents and Trademarks - Designate*